US006659623B2

(12) United States Patent
Friend

(10) Patent No.: US 6,659,623 B2
(45) Date of Patent: Dec. 9, 2003

(54) ILLUMINATION SYSTEM

(75) Inventor: Ross Anthony Friend, Somerset (GB)

(73) Assignee: Thales Optronics (Taunton) Ltd., Taunton (GB)

( * ) Notice: Subject to any disclaimer, the term of this patent is extended or adjusted under 35 U.S.C. 154(b) by 0 days.

(21) Appl. No.: 10/288,648

(22) Filed: Nov. 4, 2002

(65) Prior Publication Data

US 2003/0103347 A1 Jun. 5, 2003

Related U.S. Application Data

(63) Continuation of application No. PCT/GB01/01913, filed on May 1, 2001.

(30) Foreign Application Priority Data

May 5, 2000 (GB) ..... 0010980

(51) Int. Cl.[7] ..... F21V 21/00

(52) U.S. Cl. ..... 362/249; 359/350; 250/504 R; 362/800; 362/240; 362/219

(58) Field of Search ..... 362/249, 800, 362/240, 219, 224, 225; 359/350; 250/504 R, 494.1, 495.11, 493.1

(56) References Cited

U.S. PATENT DOCUMENTS

| | | | | |
|---|---|---|---|---|
| 5,607,227 A | | 3/1997 | Yasumoto et al. | |
| 6,283,612 B1 | * | 9/2001 | Hunter | 362/240 |
| 6,354,714 B1 | * | 3/2002 | Rhodes | 362/153.1 |
| 6,361,186 B1 | * | 3/2002 | Slayden | 362/249 |
| 6,448,570 B1 | * | 9/2002 | Scherzer et al. | 250/495.1 |

FOREIGN PATENT DOCUMENTS

| | | |
|---|---|---|
| DE | 40 35 457 A1 | 5/1992 |
| DE | 298 03 477 U1 | 8/1998 |
| EP | 0 296 554 A2 | 12/1988 |
| EP | 0 585 033 A1 | 3/1994 |
| EP | 0 747 868 A1 | 12/1996 |
| GB | 2 080 508 A | 7/1981 |
| GB | 2 207 999 A | 2/1989 |
| GB | 2 208 134 A | 3/1989 |
| GB | 2 324 901 A | 11/1998 |
| WO | WO 99/06759 A1 | 2/1999 |

* cited by examiner

*Primary Examiner*—Laura K. Tso
(74) *Attorney, Agent, or Firm*—Akin Gump Strauss Hauer & Feld, L.L.P.

(57) ABSTRACT

The invention comprises a modular illumination system comprising at least one mounting strip; one or more emitter strips each having an outwardly directed face in use through which infra red light may be transmitted; one or more printed circuit boards each carrying a plurality of infra red light emitting diodes; and one or more contact elements. The system is such that the or each emitter strip can interconnect with a mounting strip to form a conduit through which a power supply bus may be carried. Each contact element is adapted to complete an electrical connection between the power supply bus and a printed circuit board mounted behind the outwardly directed face of the emitter strip. The system is easily assembled and is advantageously used to provide a source of covert illumination for security or other monitoring purposes.

30 Claims, 9 Drawing Sheets

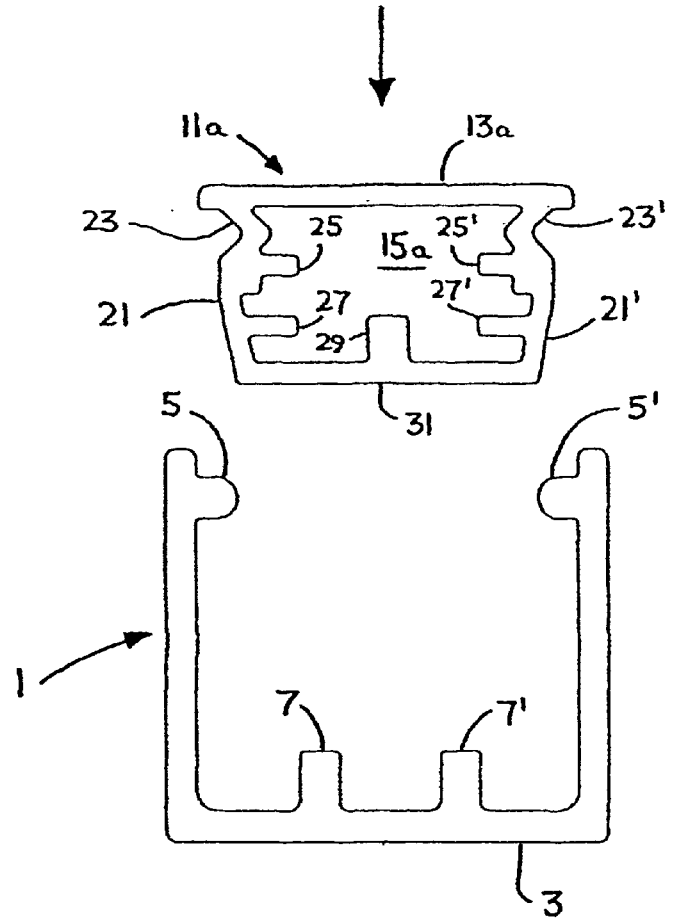
Fig. 3a
Fig. 3b
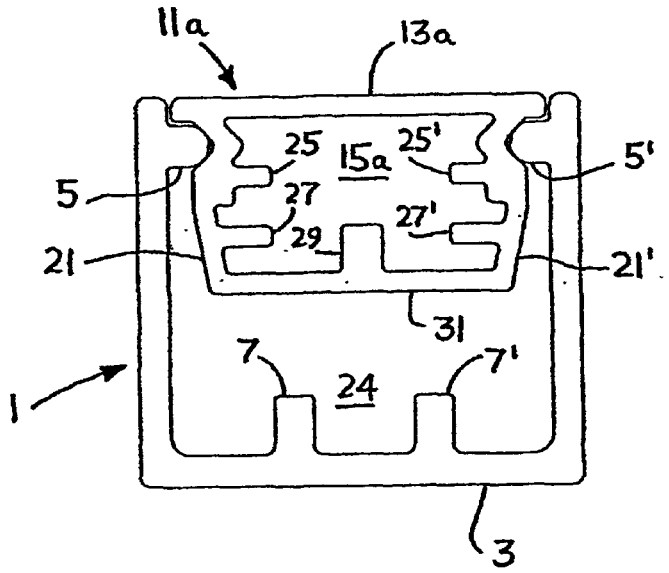

Fig. 5a
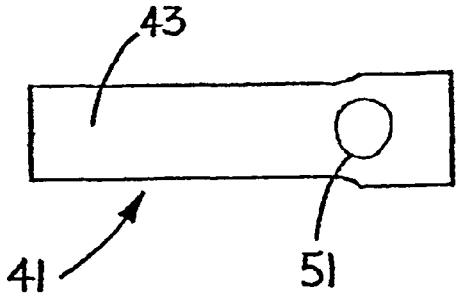
Fig. 5b
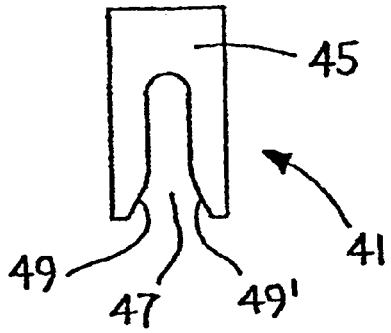
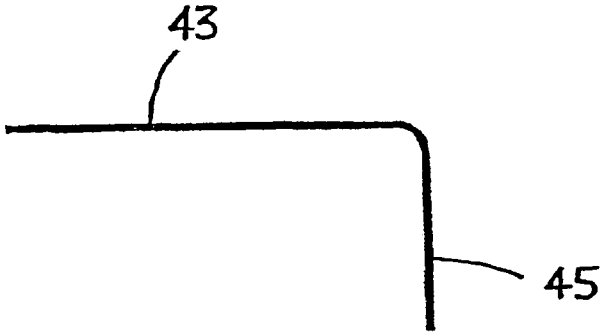
Fig. 5c
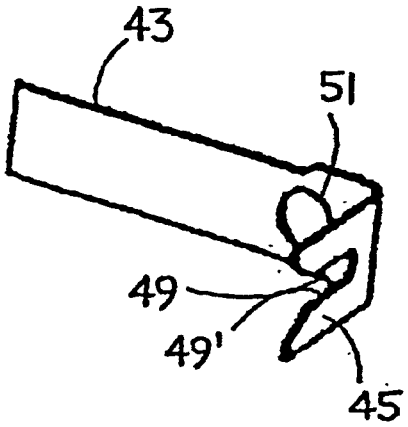
Fig. 5d

ILLUMINATION SYSTEM

CROSS-REFERENCE TO RELATED APPLICATIONS

This application is a continuation of International Patent Application No. PCT/GB01/01913, filed May 1, 2001, which was published in the English language on Nov. 15, 2001, under International Publication No. WO 01/86202 A1, and the disclosure of which is incorporated herein by reference.

BACKGROUND OF THE INVENTION

This invention relates to a system for providing a source of illumination and more particularly but not exclusively to a system for providing a source of covert illumination for use in security applications or in other monitoring situations.

The use of non-visible radiation, that is, radiation which is not apparent to the unaided eye, for surveillance purposes is well known. Commonly, a source of non-visible radiation is used to illuminate an area being monitored and one or more detectors sensitive to the radiation are provided adjacent the area illuminated which are adapted to convey an image of the area to a monitoring location which may be remote from the area. Typically, a detector may comprise a closed circuit television camera, which transmits a signal to a central monitoring location. Alternatively, the detector may comprise night vision goggles (NVGs) worn by personnel in the vicinity of the illuminated area.

For a number of reasons, including their reliability, economic power consumption and low heat emission characteristics, the use of light emitting diodes (LEDs) for generating covert illumination has become popular. However, to the best of the Applicant's knowledge, there are very few if any systems available that can provide such covert illumination in an adaptable format which can be varied to suit a particular location or target area, which is easy to install and maintain, yet which is economical to produce. Accordingly, and with these objects in mind, the Application has set out to provide a new system for providing covert illumination across a chosen area.

BRIEF SUMMARY OF THE INVENTION

From a first aspect, the present invention resides in a modular illumination system comprising:

at least one mounting strip;

one or more emitter strips each having an outwardly directed face in use through which infra red light may be transmitted;

one or more printed circuit boards each carrying a plurality of infra red light emitting diodes;

and one or more contact elements;

wherein the or each emitter strip is adapted to carry at least one of said printed circuit boards and to interconnect with the mounting strip to form a conduit through which a power supply bus may be carried and wherein the or each contact element is adapted to complete an electrical connection between the power supply bus and a printed circuit board carried by an emitter strip.

By means of the invention, it is possible to create an illumination system that may be readily adapted to suit its intended position. For example, the various components may be combined in any manner of ways to provide illumination across an extended area by utilising a plurality of mounting strips connected end to end. Moreover, the modular nature of the system is such that it does not require particularly skilled personnel to install, it being relatively straightforward to assemble and similarly straightforward to disassemble, either completely or partially for repair or replacement of individual components.

In use, the mounting strip is generally secured to a structure, such as a wall or a ceiling, adjacent an area which is to be illuminated and provides a base on which other components of the system, such as the emitter strip(s) and contact element(s), may be mounted. Preferably the mounting strip comprises an elongate U-shaped channel element in which the other components of the system may be accommodated and/or fixed as appropriate. Conveniently, the mounting strip may be secured via the base of the channel, for example, the strip may be provided with one or more apertures through which screws or other fixing elements may be passed for engagement with the structure (these apertures may, for example, be created on site by an installer to suit local conditions). In this way, once the other components of the system are mounted on the strip, the fixing elements may effectively be hidden from view and rendered inaccessible without first dismantling the system. Also, depending on how the power supply is fed to the system, this may also be concealed and rendered inaccessible. This is particularly useful when the system is used for security purposes.

In order that the mounting strip and the or each emitter strip are able to interconnect, each is preferably provided with complementary interengaging means, most preferably complementary interlocking means. For ease of manufacture and assembly, the mounting strip and emitter strip(s) are advantageously provided with means by which they may be "snap-fitted" together. For example, when the mounting strip is in the form of an elongate U-shaped channel, each leg of the "U" is preferably provided at or near its free end with one or more internal projections, ideally in the form of a continuous rib. The emitter strip(s) may then be provided on either side with one or more complementary recesses, or a continuous depression or groove, in which the projections can be accommodated.

For ease of manufacture, the mounting strip may be made, preferably by extrusion, of a plastics material, UPVC being particularly suitable. Moreover, by virtue of such material having some inherent resiliency, it is relatively easy to force each leg of the channel member outwards as an emitter strip is snap-fitted onto the mounting strip. Thus when the emitter strip is pressed into position on the mounting strip, the legs of the U-shaped channel are initially pushed outwards through contact between its projections or ribs and the outer walls of the emitter strip. Once the emitter strip reaches its desired position, the legs are able to spring back to their natural position and into the recesses or grooves of the emitter strip, thereby positively engaging and retaining the emitter strip.

So far as the or each emitter strip is concerned, as described hereinabove, these are ideally provided with complementary engaging features to those on the mounting strip in order that they may be securely retained on and by the mounting strip. When the mounting strip and emitter strip(s) are formed to create a snap-fit with each other, the emitter strip will usually be fitted to the mounting strip after the latter has been fixed in position. Accordingly, an arrangement whereby the emitter strips are provided with one or more recesses or with substantially continuous depressions or grooves and the mounting strip is provided with corresponding projection(s) is the most preferred. It will be appreciated though that the reverse arrangement may also be used.

The emitter strip of the system serves several functions; namely to co-operate with the mounting strip in such a way as to create a conduit through which an electrical power supply bus can be carried; to carry one or more of the printed circuit boards (PCBs) on which the infra red light emitting diodes (IR LEDs) are mounted; and to permit light from the IR LEDs to pass therethrough to illuminate a chosen area. It will be appreciated therefore that the or each emitter strip must be configured in such a way as to enable it to fulfil the aforementioned functions.

The ability to interconnect with the mounting strip has already been discussed. When mounted on the mounting strip, the emitter strip and mounting strip co-operate in such a way as to provide a conduit through which power supply bus may be carried. As electrical power may be supplied by means of one or more conductive strips laid or bonded, for example, to the mounting strip, the conduit does not necessarily have to be of any significant cross-section, for example, opposing faces of the mounting strip and emitter strip may be just a small distance apart when they are assembled. On the other hand, the power will more usually be supplied via one or more electric cables, generally a pair of cables, and in this case the conduit must be of sufficient cross-section comfortably to accommodate these. For example, when assembled, the base portion of the emitter strip will be spaced at least a few millimeters away from the base of the U-shaped channel of the mounting strip.

In a preferred arrangement, at least two, and more preferably several, emitter strips are interconnected to a particular mounting strip. To this end, the respective lengths of the emitter strips and mounting strip will be selected appropriately. In this way, efficient assembly of the system can be achieved. For example, the mounting strip may be of a length that is easily handled by an installer of the system and/or suitable for its intended use or position of installation. The emitter strips will generally be of a shorter length allowing ready access to the or each PCB carried on them for maintenance or repair purposes.

Advantageously, two or more, most preferably three, PCBs are associated with the or each emitter strip. While each PCB will generally carry a string of IR LEDs which are connected in series and/or parallel to suit the intended operating voltage, it is preferred that the PCBs carried by the same emitter strip are themselves connected in series.

In this regard, each PCB preferably incorporates two main power supply tracks that together provide supply continuity from one end of the PCB to the other end of the PCB. The IR LEDs may be connected to this supply in one or more series strings, the number of diodes and strings per PCB being dependant on the operating voltage and brightness required. Accordingly, when the electrical connection is made to the supply bus carried through the conduit via the contact element(s), the IR LEDs from one PCB to the next are therefore connected in parallel. Such an arrangement allows one or more diodes to fail without affecting the other PCBs or the other LED strings within the same emitter strip.

In the preferred case where a plurality of emitter strips are utilised in the system, the electrical connection provided from each emitter strip to the power supply via a respective contact element is such as to provide parallel circuits. Thus, in the event of failure of a PCB resulting in loss of illumination, IR LEDs on an adjacent emitter strip or adjacent PCB should still be operative. Furthermore, even if a PCB is broken in two effectively severing the supply, only the subsequent PCBs within the same emitter would be rendered inoperative. Accordingly, the system can suffer a complete failure of any of the emitter strips without affecting the operation of the remaining emitter strips.

To further guard against loss of emitted light in any area selected for illumination, each emitter strip and/or PCB will preferably be of a length or lengths that ensure illumination still reaches a monitored area from an adjacent PCB in the event of one PCB failing. For example, the failure of a PCB carried on one such emitter strip will not necessarily result in the absence of illumination in the target area because there will be another PCB adjacent, either on the same emitter strip or on a neighboring emitter strip. As will be appreciated, LEDs are generally very reliable and so failure will be rare. Accordingly, the chance of adjacent PCBs failing is remote, and hence users of the system may be assured that the system is virtually failsafe.

Typically, a mounting strip may be provided in lengths of about 3 m long, this being close to the maximum length which an installer can readily handle but can be cut to size according to its intended place of installation, and the emitter strips may each be provided in lengths of about 1 m. In addition, each emitter strip will typically carry three PCBs with each PCB carrying about 12 IR LEDs, substantially regularly spaced there along. However, in the modular system of the invention, a range of lengths for both mounting strips and emitter strips may be made available, further enhancing the flexibility of the system.

Most conveniently, the or each PCB will be associated with an emitter strip prior to fitting to the mounting strip. Conversely, replacement of a PCB, for example in the case of failure, will generally involve only the detachment of that emitter strip on which it is carried, not complete dismantling of the system or even detachment of adjacent emitter strips. Whilst it would be possible to replace a defective PCB by first removing the relevant emitter strip, then removing the defective PCB and inserting another as appropriate, to simplify maintenance of the system, it is preferred that the emitter strip carrying the defective PCB is replaced in its entirety with another such strip carrying a new set of PCBs.

Advantageously, the or each emitter strip comprises a hollow elongate member for accommodating one or more PCBs inside. In this way, the PCBs can be retained within the strip so that their surfaces are protected against damage during the fitting of the emitter strip to the mounting strip or its detachment therefrom. Another benefit of such an arrangement is that the IR LEDs mounted on the PCB are further shielded from external influences, such as ingress of dust, or more seriously, from rain or other fluids to which the system may be exposed.

In order to facilitate correct alignment of the PCB and hence the IR LEDs on insertion of the PCB into the hollow interior of an emitter strip, the hollow portion may incorporate a relatively narrow slot into which the PCB may be slid. The width of any such slot is selected to support and retain the PCB along its outer edges and at the same time avoiding contact or other interference with its circuitry. Ideally, the hollow portion will be configured so as to create a gap above the PCB and more preferably below as well. On one side, the gap should be sufficient at least to accommodate the IR LEDs that will generally be surface mounted and hence project above a face of the PCB. Further, by also providing a gap on the opposite face, improved circulation of air around the PCB will be possible thereby helping dissipate any heat generated by the IR LEDs in use.

The hollow interior of the emitter strip will also be ideally configured in such a way that the or each PCB can be held in position once correctly inserted thus facilitating a secure electrical connection between adjacent PCBs or between a PCB and an adjacent contact element. Moreover, while it would be possible to provide a direct electrical connection between adjacent PCBs and/or between a PCB and an adjacent contact element simply via conductive tracks on the PCBs, a preferred arrangement is to create the connection via an intermediate connector or bridge. In this regard, jumpers, particularly spring jumpers are especially preferred, as these are easy to insert and hence contribute to reducing assembly costs. Furthermore, spring jumpers and the like provide an additional benefit in terms of their ability to urge their associated PCBs against a supporting surface, for instance against the slot provided in the hollow emitter strip. In this way, a restraining force may be applied on the PCB that substantially prevents or at least hinders any unintentional movement of the PCB once installed.

When separate electrical connectors are used between adjacent PCBs and/or between a PCB and a contact element mounted at the end of an emitter strip, allowance will be made in the respective lengths of the emitter strip and each PCB so that the combined lengths of connector(s) plus PCBs broadly corresponds to the length of the emitter strip. Electrical connectors, such as the aforementioned spring jumpers, may therefore be included as a further component of the modular illumination system of the invention.

In order to permit light emitted from the IR LEDs to pass through the emitter strip, at least an outwardly directed face in use or "cover" face of the emitter strip should be made of a material which has very little attenuation at the desired waveband(s). Typically, the system will operate at a waveband in the region of about 880 nm as determined, for example, by the LED specification, the peak sensitivity of associated CCTV cameras and the minimum sensitivity of the human eye. Moreover, as it will often be the intention that the system is unobtrusive, in the sense that it is not immediately recognizable as a security feature, the cover face may be substantially opaque to visible light. Most preferably, the emitting face will appear "smoked.

As with the mounting strip, the emitter strip is also preferably formed by extrusion and therefore will generally be of uniform cross-section across its length. The emitter strip may be of substantially rectangular in cross-section, providing for easy co-operation with a U-shaped, channel-section, mounting strip. However, a substantially tubular emitter strip may be equally suitable. Depending on the particular configuration of the emitter strip, the cover face may be co-extruded with the remainder of the strip or alternatively may be extruded separately therefrom and joined, for example by welding, to the remainder. Equally, the emitter strip may be extruded from a single material, provided this has the necessary optical properties. A materials such as a polycarbonate or a PVC is preferred for this purpose.

The emitter strip may be extruded and thereafter supplied in pre-cut format in the desired lengths, typically in the order of about lm as suggested above. Alternatively, it is envisaged that the emitter strip may also be supplied in substantially continuous form, for example, in reels of, say, up to 25 m from which lengths can be cut in situ. While the former may be more suitable for strips of relatively rigid material, typically of substantially rectangular cross-section, the latter would only be feasible if the material had a sufficient degree of flexibility to allow it to be wound and in this case a tubular configuration may be more appropriate.

In order to convey current from a power supply bus carried in the conduit created between the mounting strip and an emitter strip to the PCB(s) carried on the emitter strip, one or more contact elements are included in the system of the invention. It will be appreciated that where, for example, the power supply bus comprises a pair of conductive tracks or wires, a pair of contact elements will be required to complete each electrical connection. For simplicity, however, and unless specifically stated to the contrary, the term "contact element" as used herein embraces both a single contact element and a pair of contact elements.

Clearly the contact element must be made from a conductive material and, bearing in mind that many of the intended uses of the illumination system will involve exterior installation, stainless steel is the currently preferred material of choice.

Ideally, each contact element serves to complete a parallel circuit between the PCB(s) and the power supply bus. Generally, each emitter strip will be associated with a contact element. In a typical arrangement, the or each contact element will be required to form an electrical contact between a power supply bus carried through the conduit created between an emitter strip and mounting strip and the conductive tracks at the end of a PCB running substantially parallel to this. This contact may either be direct between the two or be indirect by means of an intermediate connector, such a spring jumper, connected to a PCB. To ensure a proper contact with the conductive tracks of the PCB or an intermediate connector, the contact element preferably overlaps with the tracks or connector in use. Accordingly, each contact element preferably comprises two arms one which runs parallel to and overlaps with the conductive track or intermediate connector and the other arm which makes contact with the power supply bus from above (or below, depending on the orientation of the installed system). To this end, the or each contact element preferably comprises a pair of contact arms disposed at about 90° to each other, most conveniently in the form of a substantially L-shaped member.

For ease of installation and maintenance, the or each contact element may be integral with an emitter strip or combined therewith into a sub-assembly ready for attachment to a mounting strip. Equally, the or each contact element may comprise a separate, stand-alone, component of the system.

It will be appreciated that in its simplest form, the system of the invention requires a contact element for each emitter strip on the mounting strip. However, it is possible to envisage a contact element having dual contact points, the first for contacting a PCB carried on an emitter strip lying to one side and the second for contacting another PCB carried on another emitter strip lying to the other side, each completing a separate parallel circuit with the power supply.

When the power is fed through the system via an insulated electric cable, most commonly via a pair of cables, one positive the other negative, the or each contact element may conveniently be adapted to forge the connection to the electrical conductor through the cable insulation. To this end, the or each contact element advantageously comprises a contact blade which cuts through the insulation of the cable as it is pushed home. In order not to sever the electrical conductor carried through the cable, the blade is shaped to cut only through the insulation and simply to make contact with the conductor. For example, the blade may be defined by a recess in the contact element, the recess defining a cutting edge and having a diameter substantially equivalent to the inner diameter of the cable insulation. Such a recess may be formed by etching of the metal, this process naturally resulting in a cutting edge being formed.

One particular advantage of this type of connection, as with the connection formed using the aforementioned spring jumpers, is that a relatively high contact pressure and hence a relatively gas-tight contact may be achieved, with the consequence that corrosion at the contact face may be minimised.

Preferably, the or each contact element is supplied on a connector block adapted for mounting on the mounting strip. Such a connector block preferably interconnects with the mounting strip, ideally in the same way as does the emitter strip(s). In other words, the same complementary interlocking features as may be shared between mounting strip and emitter strip are also provided between mounting strip and connector block. Most conveniently this is achieved through the aforementioned "snap-fit" arrangement. In a preferred form, the action of engaging the connector block with the mounting strip effects the necessary electrical connections, for example by means of a contact blade cutting into the cable insulation as the connector block is pushed home.

As well as providing a convenient means by which the necessary electrical connection may be made, the use of a connector block to carry the contact element can provide aesthetic benefits. In particular, since its visible profile in use will ideally correspond to that of the cover face of an emitter strip, together they can create the impression of a substantially continuous outwardly directed face.

In a particularly preferred arrangement, a pair of contact elements is carried on a single connector block, each contact element comprising an elongate metal strip bent into an L-shaped configuration. One leg of the "L" comprises a contact blade for forging an electrical contact with an insulated cable and the other leg is adapted to connect with a conductive track on a PCB carried on an emitter strip, either directly or indirectly via a spring jumper or the like.

Moreover, to guard against either or both the contact blades being deformed as they are pressed onto the cable in use, or bent so as not to align with the conductive tracks or intermediate connector, the pair of contact elements are preferably constrained by their associated connector block. This is most conveniently achieved by forming the connector block around the contact element(s), such as by moulding the block around the contact element(s), or rather around those parts of the contact elements where direct electrical contact is not required.

In a preferred form the connector block comprises a generally L-shaped moulding, typically made from nylon or the like, on which a pair of L-shaped contact elements are retained. A laterally extending arm of the block in use provides a supporting surface for the corresponding laterally extending arms of the contact elements. Furthermore, the laterally extending arm of such an L-shaped connector block is ideally profiled to fit inside the hollow interior of an emitter strip. For example, it may have a width approximating to that of a PCB such that it may be inserted into the same slot as the PCB is slid into. In this way, the laterally extending contact elements on the connector block may be correctly aligned with the conductive tracks on the PCB. Connection between the contact elements and a PCB may be direct or indirect as hereinbefore described.

The other arm of such an L-shaped block preferably substantially encases the arms of the contact elements extending vertically relative to the lateral arms thereby providing optimum support. However, the area of each contact element which surrounds its recess (and which forms the contact blade) is permitted to remain exposed. Accordingly, the vertically extending arm of the connector block may be provided at its distal edge with twin recesses (effectively short channels) running parallel to the longitudinal axis of the system and into which the pair of blades protrudes.

By configuring the connector block so that it co-operates with a feature on the emitter strip, such as by means of an arm of the connector block fitting within the hollow interior of the emitter strip as described above, it is possible to secure both components to the mounting strip and complete the electrical connection in a single action. For example, an installer can insert the arm of the connector block into the hollow interior of the emitter strip until the vertical arm of the connector block abuts the strip, then both can be pushed home on the mounting strip. Preferably, however, the connector block is also bonded to the emitter strip, so that a waterproof seal is achieved between the two. Moreover, by providing the emitter strip and connector block as a subassembly, the installer is faced with fewer separate parts to fix on to the mounting strip.

To further facilitate efficient installation of the system, the mounting strip may be provided with features complementary to those on the connector block to assist in urging the electrical cables into the recesses on the connector block. For example, the mounting strip may be provided along its length with a pair of ribs that correspond to the position of the recesses on the connector block. In practice, these ribs effectively co-operate with the recesses to force the cables into the recesses and hence make the connection to the power supply.

It will be further appreciated that when contact blades are used to forge the electrical connection by cutting through the cable insulation of the power supply, the insulation serves to provide a seal around the contact. In this way, the ability of the illumination system to withstand external conditions may be enhanced. Moreover, the action of cutting into the cable effectively results in the cable being clamped in position within the conduit created between the mounting strip and emitter strip(s). This clamping action also serves to restrain relative movement between other components of the system, most notably between the mounting strip and emitter strip(s).

In addition to the components of the illumination system previously described, other components may also be included. For example, in order to maintain an effective seal against ingress of rain, dust or other undesirable substances, the system advantageously further includes one or more end caps. Primarily, the end caps are configured to protect or shield the PCBs carried on the emitter strips from external influences.

The or each end cap is preferably also configured to co-operate with both the mounting strip and an emitter strip. In a particularly preferred form, the or each end cap has a similar cross-section to that of a connector block, for example, to provide a snap-fit onto the mounting strip. Further, the or each end block is ideally provided with a laterally extending projection which is capable of being inserted into and closing the hollow interior of an emitter strip at one end. As with the connector block, it is preferred that the or each end cap is associated with an emitter strip prior to fitting onto the mounting strip. Ideally, both the end cap and connector block are bonded to an emitter strip in a subassembly of all three components, thereby keeping to a minimum the number of separate parts which together make up the system and assisting to make the system substantially weatherproof.

As with the preferred form of connector block, one or more recesses, usually a pair, may be provided to permit entry of the power supply into the conduit between the mounting strips and emitter strip(s). Thus the end cap may also provide the means by which the power and data connection can be made between the PCB(s) and the outside world. The provision of recesses is of particular value where a plurality of mounting strips are mounted end-to-end and the cable is of a length suitable for passage across several or indeed all of the mounting strips. Where cables or conductive tracks are "pre-installed" on the mounting strip, such recesses may comprise an electrical socket into which a cable connector running from a power supply may be inserted to complete the power supply bus.

Rather than being fed laterally into the conduit created between the mounting strip and emitter strip, any electric cables used to supply power may alternatively be fed into the system through the mounting face of the mounting strip, for example through a suitable aperture provided in the mounting face. This arrangement may be particularly suitable where a single mounting strip is used as the power supply will only be accessible when the system is being installed or dismantled. In such a case, the end cap would not be required to have the aforementioned recesses. To cater for different system configurations, in keeping with the modularity of the system, a combination of end caps, both with and without recesses, is preferably provided. In this way, the installer of the system can select an appropriate end cap for the circumstances involved.

In order to facilitate removal of an end cap once fitted, for example to allow a PCB carried on an adjacent emitter strip to be replaced, the outer side face of the end cap (the "end face") may be provided with an indentation or the like into which the end of a tool, such as a screwdriver or similar instrument, may be inserted and then used to lever out the component.

The end cap(s) may be formed from the same or similar material as that used for the other components, nylon being particularly preferred, and may be conveniently produced by injection moulding.

The system according to the invention preferably further includes one or more spacer blocks. Such spacer blocks are usually of relatively short length as compared to the length of an emitter strip or mounting strip, typically about 10 mm long. The or each spacer block is generally formed to co-operate with the mounting strip in the same way as an emitter strip, connector block and/or end cap. Accordingly, the spacer block may share such features as a pair of grooves on opposing side faces to interlock, that is snap-fit, with corresponding projections formed on the mounting strip.

In order to ensure that the conduit created between the mounting strip and emitter strip(s) remains uninterrupted, the spacer unit will preferably be provided with one or more recesses, usually a pair, in common with the preferred configuration of the connector block and, in one of its forms, the end cap. These recesses permit passage of cables therethrough in the same way as the other components mentioned.

The spacer block may serve a number of valuable functions that enhance the ease of use and flexibility of the system. For example, when used in the system, a spacer block will usually be fitted to the mounting strip before an adjacent emitter strip is installed, thus one function of the spacer block is to assist in positioning and holding power supply cables in place while the emitter strip is fixed onto the mounting strip. Preferably the system includes one spacer block for each emitter strip mounted on the mounting strip.

Another desirable function of the spacer block is to provide an access point to an emitter strip once this has been fitted to the mounting strip. Accordingly, in order to facilitate removal of an emitter strip, it is particularly preferred that the spacer block be readily detachable from the system. To this end, each spacer block may be provided with an access point in which an implement, such as a screwdriver, may be inserted to eject the block. In order not to detract from the neat appearance of the assembled system, such an access point is ideally provided close to, but not on, the spacer block's external face in use. For example, the outer face in use of the spacer block may comprise a thin section which is easily forced by a screwdriver or the like allowing the spacer block to be prised out of the system. Once dislodged, the screwdriver or other such tool can then be used to lever out the emitter strip either directly, such as by levering the screwdriver against its hollow interior, or indirectly, such as by levering the screwdriver against an indentation or other such feature provided on a side face of a connector block.

While damage may occur to the spacer block through this action, the block may be easily replaced with a new block when the system is re-assembled. However, by virtue of its ease of manufacture and low material cost (for example, the spacer block is preferably made of a plastics material, such as nylon, which is injection moulded), the cost of replacement is relatively insignificant.

Moreover, in the event that it becomes necessary to dislodge an emitter strip after installation, for example to replace it or to replace one or more of the PCBs carried thereon, this will usually involve dislodging an associated connector block as well (especially if the connector block is one having an arm that extends into the hollow interior of the emitter strip or is otherwise joined to the emitter strip). Accordingly, if the emitter strip were to be replaced in exactly the same position as previously, there is a risk that the contact blades on the connector block may not make good contact if placed back in the "grooves" cut in the cable insulation during the previous fitting. To avoid this risk, the spacer block can be re-positioned at the opposite end of the emitter strip from that where it was first placed. In this way, the emitter strip and hence the connector block may be displaced by the length of the spacer block thus allowing a fresh connection to be made.

As will be understood, the system of choice is one in which the profiles of the various components share the same general features so that each can engage with the mounting strip in substantially the same manner. In this way, little if any skill or effort is required to install the system. For example, it may be a simple matter of affixing one or mounting strips to a surface adjacent to the area to be illuminated and pressing the other components onto the mounting strip(s) in a pre-determined combination and order. Moreover, when the engagement of the components is by a snap-fit with the mounting strip, the system may effectively be "self-sealing" against the elements.

A particularly preferred system is one in which the number of separate "pieces" required for installation is kept to a minimum. In this regard, the or each emitter strip is advantageously provided as a subassembly in conjunction with a connector block and an end cap. Ideally these three components are welded or otherwise sealed together to form a single unit.

Expressed in another way, the present invention resides in a covert illumination system comprising:

- a mounting strip;
- a sealed hollow emitter strip including a plurality of IR LEDs mounted on a PCB housed inside and a contact element bridging the seal providing an electrical connection to the PCB; and
- a power supply bus;
- wherein the emitter strip is adapted to engage the mounting strip such that the power supply bus is retained therebetween in contact with the contact element thereby completing an electrical circuit with the PCB.

The various preferred and optional features of the system as hereinbefore described are equally applicable to this alternative expression of the present invention. For example, an end cap and connector block may be combined with the basic emitter strip to form the sealed hollow emitter strip and the inclusion of one or more spacer blocks is especially preferred for the same reasons already mentioned.

For optimum performance, the system of the invention is preferably linked to an independent power supply unit. In this way, it is possible to control the power to provide the desired voltage and current characteristics, these being important to ensure the IR LEDs are driven correctly. Moreover, a back-up power supply may be linked to the system to cater for instances of power failure from the mains supply.

Typically, the system may be designed to operate at low voltages, for example at 12V dc, although operation at higher ac voltages may be contemplated. For example, a 12V dc supply could enable up to 25 or more emitter strips to be connected together in the system. A 24V ac supply could allow even more, say up to 50 or so, emitter strips to be connected in a run. In terms of its low power consumption and low heat emission the system is inherently safe and compares favourably with standard IR lamps that have traditionally been used for providing the illumination.

Generally, the illumination system will include power conditioning means, preferably in the form of a constant current source, for controlling the power to the IR LEDs. However, the system is preferably adapted so that it may be installed in many different environments, including hostile environments, where external daytime temperatures can be extremely high yet night time temperatures very low. In this regard, it is preferred that the current source be temperature compensated. By such means, it is possible to run the IR LEDs at a higher current and hence brightness during times of darkness. On the other hand, if the system is still switched on during the daytime when the temperature rises, the current can reduce proportionately thereby guarding against damage of the diodes. As the temperature drops towards nightfall, the current will rise again to a level sufficient to power the diodes to provide the desired illumination.

Separate power conditioning means will ideally be incorporated in the or each PCB and in this way, will not only act to maintain a constant current through the diodes, but will also provide overvoltage and reverse polarity protection. As previously mentioned, the IR LEDs are ideally configured in strings of series connected diodes, each string being then connected in parallel. Accordingly, it is preferred that power conditioning means be provided for each and every string.

The actual number of IR LEDs surface mounted on each PCB may vary according to certain requirements, for example, depending on the required illumination intensity and power consumption. The number of diodes per PCB will also depend on the length of the PCB in conjunction with the desired diode density. A typical PCB for use in the present system may be about 330 mm in length such that three such PCBs can be carried on an emitter strip of about 1 m length, and may carry about 12 diodes. Conveniently, the PCBs may be rigid GRP or flexi circuit boards.

Various modifications to the basic system described hereinabove are also contemplated. For example, in order to permit the system to act as a zonal intruder detector, the system may optionally include a passive infra red (PIR) sensor. When present, the sensor is preferably linked to the system in such a way as to transmit a modulated signal to the power supply bus. Conveniently, this may be achieved by modifying one of the components of the system to incorporate a PIR sensor. For example, a PIR sensor may be incorporated into an emitter strip, possibly modified to be of shortened length as compared with an emitter strip of "normal" length, and may utilise a common connector block. However, instead of housing one or more PCBs carrying IR LEDs, the strip may instead include a PCB carrying an IR detector and associated detector circuitry. The circuitry may advantageously incorporate a DIL switch or the like providing an individual, unique identifying code.

When such a PIR sensor is incorporated in the system, a modulated code can be transmitted to the power supply bus when an intruder is detected. Ideally, the system may further comprise a demodulator unit for demodulating and decoding data transmitted to the power supply bus, and providing a standard serial or parallel data interface for connection to an integrated security system. In this way, a warning signal may be passed to an alarm central processor unit that, by means of the aforementioned unique code, provides the information necessary to identify where a suspected intrusion has occurred.

A yet further component which may be included in the system is a photodetector unit, in this way it is possible to control the power supplied to the emitter strips so that illumination occurs only during periods of darkness or low light conditions. The photodetector unit may be provided remotely, as a discrete unit, or may alternatively comprise an integral part of the power supply unit.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings:

FIGS. 3*a* and 3*b* are end views of the mounting strip of FIG. 1 and another emitter strip shown in separated and mounted positions respectively;

FIGS. 5*a* to 5*d* show respectively a plan view, an end view, a side view and a perspective view from below of a contact element for use in a preferred embodiment of the invention;

DETAILED DESCRIPTION OF THE INVENTION

Figure 1:
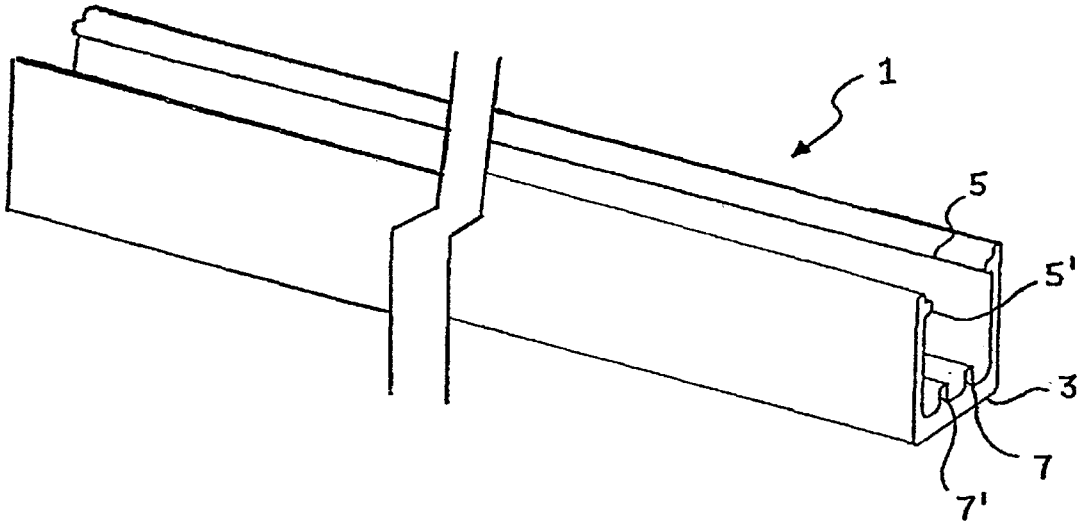
FIG. 1 is a perspective view of a mounting strip for use in a preferred embodiment of the invention.

Referring firstly to FIG. 1 of the drawings which illustrates an extruded plastics mounting strip 1 of a generally U-shaped section. The mounting strip 1 is provided on its base 3 with fixing holes (not shown) through which screws or the like may be passed to secure the mounting strip 1 to a structure, such as a ceiling. Internally projecting ribs 5, 5' are provided along opposing side walls of the mounting strip 1 towards the open end of the channel section. A further pair of ribs 7, 7' extend along the base 3 projecting into the channel section.

Figure 2:
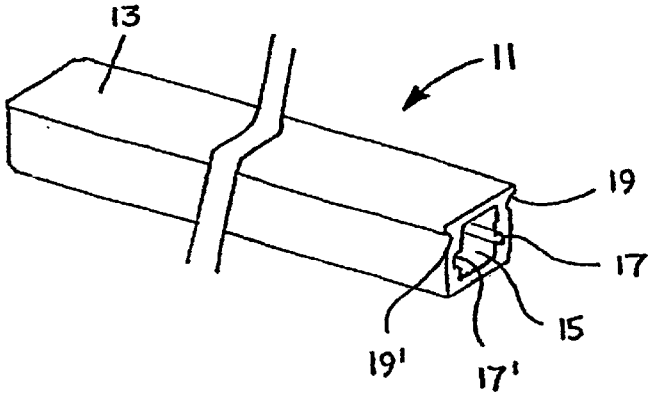
FIG. 2 is a perspective view of an emitter strip for use in a preferred embodiment of the invention.

FIG. 2 illustrates an extruded plastics emitter strip 11 of a substantially rectangular hollow section, the cover face 13 of which permits transmission of infra red radiation. The hollow interior 15 of the emitter strip 11 is also generally rectangular, with a pair of continuous grooves 17, 17' on opposing side walls which together form a slot into which one or more PCBs (not shown) can be slid. Each of the outer side walls are provided towards its upper end with a continuous recess 19, 19' into which the ribs 5, 5' of the mounting strip of FIG. 1 can be snap-fitted.

FIG. 3*a* shows an end view of the mounting strip 1 of FIG. 1 and an extruded plastics emitter strip 11*a* of different cross-section externally and internally to the emitter strip 11 of FIG. 2. Emitter strip 11*a* has outwardly inclined side walls 21, 21' each terminating with a substantially V-shaped recess 23, 23' and capped with cover face 13*a* through which infra red light can transmit. The walls of the hollow interior of emitter strip 11*a* are provided with two pairs of inwardly projecting ribs 25, 25', 27, 27' which together create a slot for receiving and retaining the PCB(s). A further upstanding rib 29 is provided along the base 31 of the emitter strip 11*a* also projecting into its hollow interior 15*a*. Rib 29 serves as a guide and separator for spring jumpers (not shown) thereby helping promote a reliable contact between the jumpers and the conductive tracks on the PCB(s) and reducing any risk of the spring jumpers shorting together. Rib 29 also helps strengthen the profile of the emitter strip 11*a* and assists in guiding the PCB(s) on the face opposite the IR LED-bearing face during its insertion.

FIG. 3*b* shows the emitter strip 11*a* fitted on the mounting strip 1 after the emitter strip 11*a* has been pressed on to the mounting strip. The ribs 5, 5' of the mounting strip 1 are effectively "trapped" in the V-shaped recesses 23, 23' of the emitter strip 11*a*, locking the two parts together. The interconnected parts together create a conduit 24 through which a power supply bus may be carried.

Figure 4:
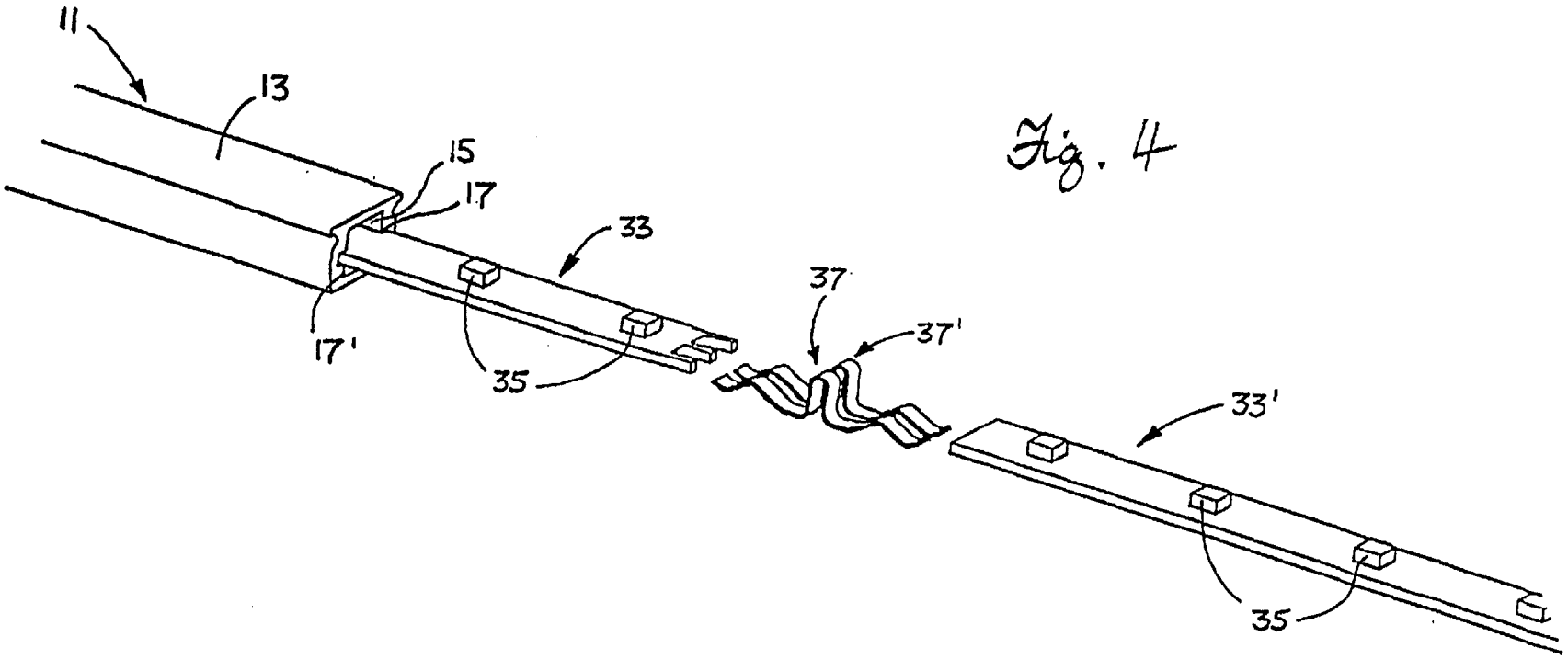
FIG. 4 is a perspective view of a pair of PCBs, one partially inserted in an emitter strip, together with a spring jumper for electrically connecting the pair.
Figure 6A:
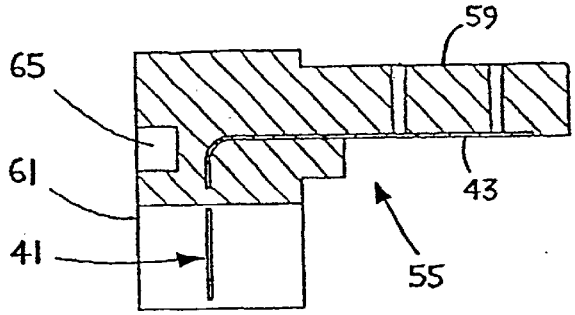
FIGS. 6*a* to 6*e* show respectively a cross-section, an end view, a bottom view, a perspective view from above and one end and a perspective view from below and the other end of a connector block incorporating a pair of contact elements as shown in FIGS. 5*a* to 5*d;*
Figure 6B:
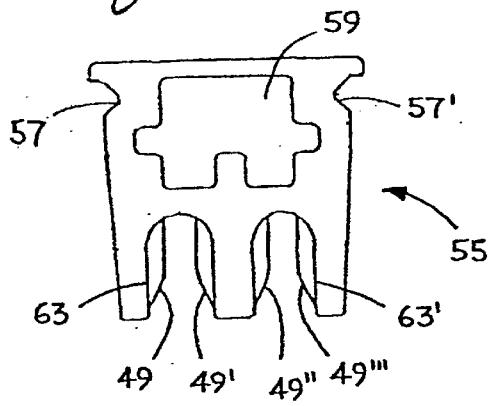
Figure 6C:
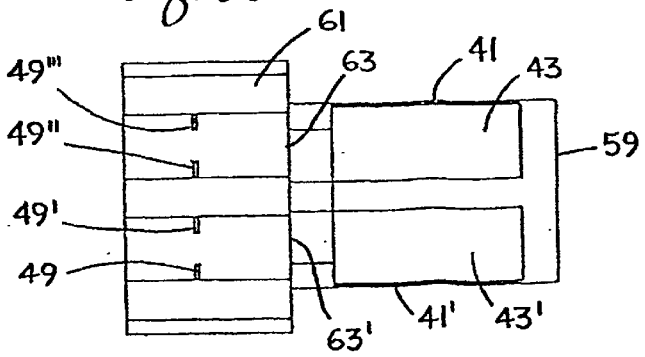
Figure 6D:
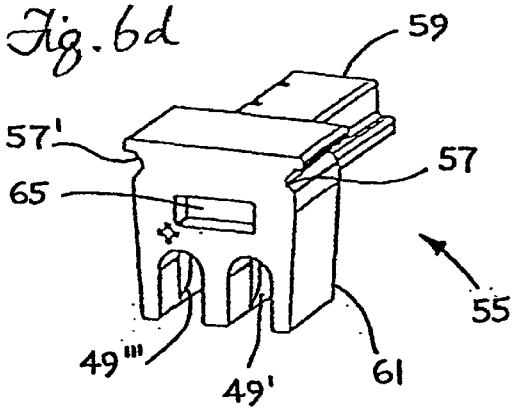
Figure 6E:
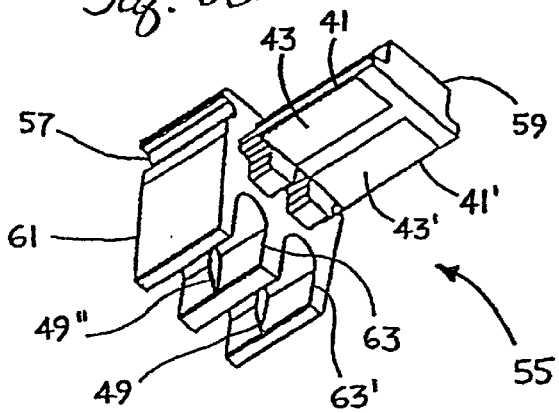

FIG. 4 illustrates an extruded plastics emitter strip 11 as shown in FIG. 2 in which a PCB 33 has been partially inserted into its hollow interior 15. The PCB 33 slides into the slot created by grooves 17, 17' with the surface mounted IR LEDs 35 facing towards the cover face 13. The depth of the hollow interior 15 is such as to accommodate comfortably the IR LEDs 35 and allow some air circulation around them. A pair of spring jumpers 37, 37' is fitted between adjacent PCBs 33, 33' to make contact with the conductive tracks (not shown) on their respective undersides. Once in position, with both PCBs 33, 33' inserted in the hollow interior 15, the spring jumpers 37, 37' push against the undersides of each PCB 33, 33' and urge them against the horizontal slot walls. In this way, the PCBs 33, 33' are not lying loose inside the emitter strip 11 and the electrical connection is secure.

FIGS. 5*a* to 5*d* show views of a thin metal contact element 41 for forming the electrical contact between a PCB (not shown) and a power supply bus (not shown) in an illumination system according to the invention. Contact element 41 is substantially L-shaped and has a generally flat first arm 43 suitable for forming an electrical connection with a conductive track of a PCB 33 or a spring jumper 37 as shown in FIG. 4. Second arm 45 depends from the first arm 43 and has at its distal end an inwardly tapering recess 47. The recess 47 effectively creates on either side a pair of blades 49, 49' that are able to cut through the insulation of an electrical cable (not shown) and form an electrical contact with the conductor wire passing through the centre of the cable. Aperture 51 through the first arm 43 is provided as a key through which plastics material can flow when the contact element 41 is retained in a moulded connector block as shown in FIGS. 6*a* to 6*e* discussed hereinafter.

FIGS. 6*a* to 6*e* show a moulded plastics connector block 55 on which a pair of contact elements 41, 41' each substantially as illustrated in FIGS. 5*a* to 5*d* are located. The connector block 55 made of moulded plastics has a pair of substantially V-shaped recesses 57, 57' on its opposing side walls for snap-fitting with the ribs 5, 5' of a mounting strip 1. The connector block 55 is moulded around contact elements 41, 41' so that the lower faces of first arms 43, 43' are exposed but supported by its laterally extending arm 59. Arm 59 has a cross-section adapted to fit into the hollow interior 15*a* of the emitter strip 11*a* of FIGS. 3*a* and 3*b*. The depending arm 61 of the connector block 55 is provided on its bottom face with a pair of recesses 63, 63' into which the blades 49, 49', 49", 49'" of the contact elements 41, 41' project. An aperture 65 is provided to enable a tool, such as a screwdriver, to be inserted as necessary to lever out the connector block 55 after it has been fitted in the system.

Figure 7A:
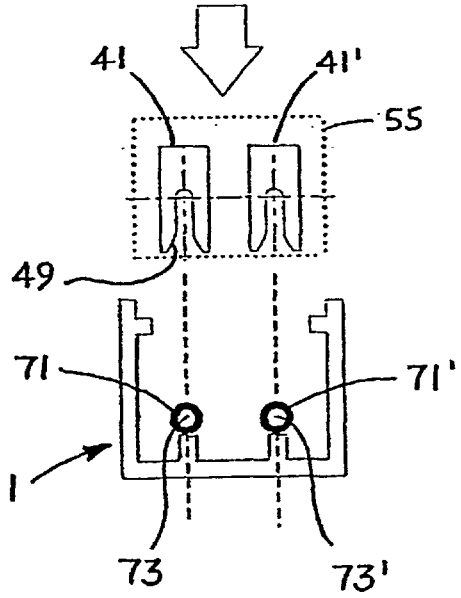
FIGS. 7*a* to 7*c* are simplified schematic end views of three stages showing the connection of a pair of contact elements to a pair of electric cables running through a mounting strip.
Figure 7B:
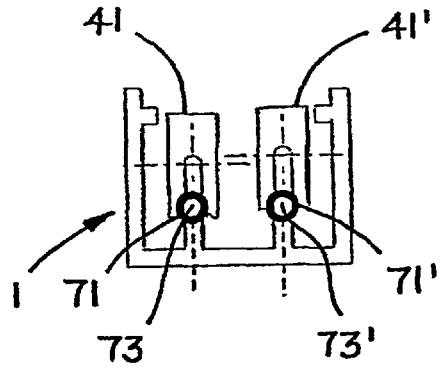
Figure 7C:
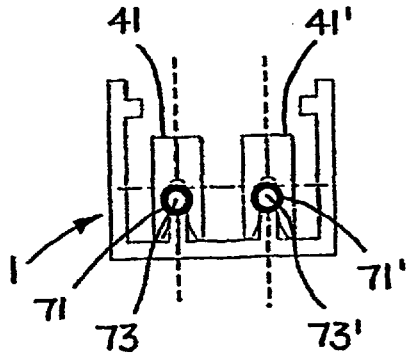
Figure 8A:
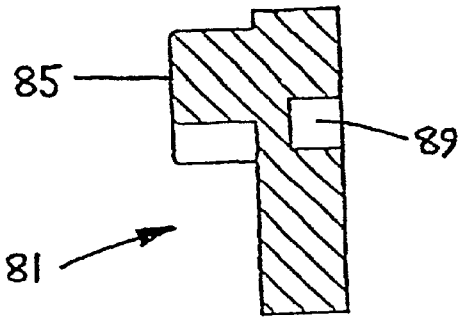
FIGS. 8*a* to 8*d* show respectively a cross-section, an end view, a perspective view from above and one end and a perspective view from above and the other end of an end block.
Figure 8B:
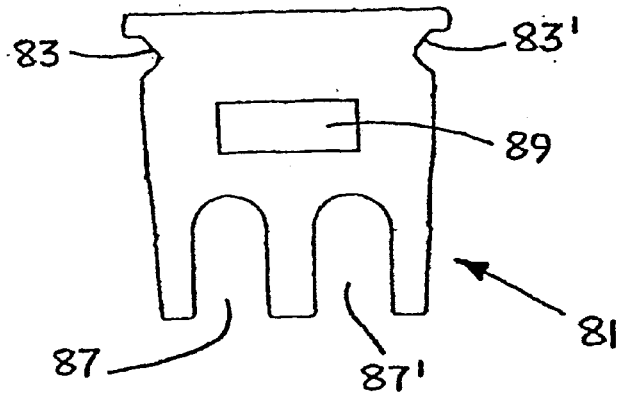
Figure 8C:
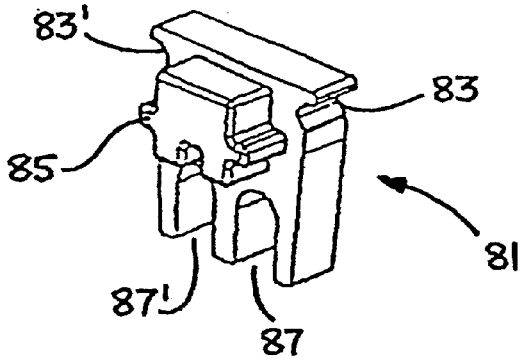
Figure 8D:
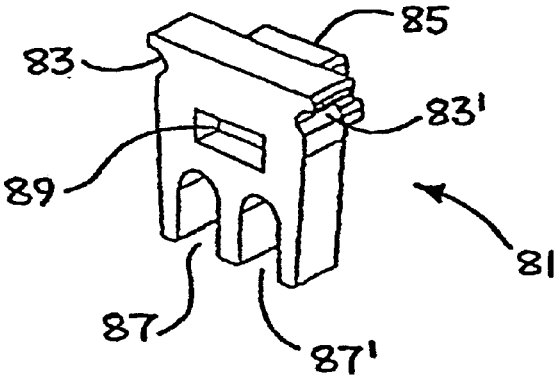

FIGS. 7*a* to 7*c* illustrate schematically how the connector block 55 is mounted on the mounting strip 1 to forge an electrical connection with a power supply bus comprising insulated cables 71, 71'. As shown in FIG. 7*a*, parallel insulated cables 71, 71' aligned along the ribs 5, 5' run through the base 3 of the mounting strip 1. The connector block 55 (shown schematically in outline by dotted lines) is brought towards and pushed into the mounting strip 1 as shown in FIG. 7*b*. As the connector block 55 is lowered, the cables 71, 71' enter the recesses 63, 63', whereupon blades 49, 49', 49", 49'" of contact elements 41, 41' cut into the insulated cables 71, 71'. When the connector block 55 is pushed fully home as shown in FIG. 7*c*, the blades 49, 49', 49", 49'" which have now cut through the insulation are in electrical contact with the conductive wires 73, 73' running through the cables 71, 71'.

FIGS. 8*a* to 8*d* illustrate a moulded plastics end cap 81 used to terminate and seal an end face of an emitter strip 11. As with the emitter strip 11*a* and connector block 55, the outwardly inclined walls of the end cap 81 terminate in substantially V-shaped recesses 83, 83' for snap-fitting with ribs 5, 5' on the mounting strip 1. A laterally extending projection 85 has a profile which can be inserted into the hollow interior 15*a* at one end of emitter strip 11*a* thereby preventing ingress of rain or the like into the emitter which might otherwise interfere with the functioning of the system. In order to allow cables to be fed into and pass through into the conduit created when the mounting strip 1 and emitter strip 11*a* are fitted together, recesses 87, 87' are formed in the end cap 81 like those present in the connector block 55 described above. The end cap 81 is also provided on its outer face in use with an aperture 89 into which the end of a tool, such as a screwdriver, may to be inserted to lever out the part out after it has been fitted to the mounting strip.

Figure 9A:
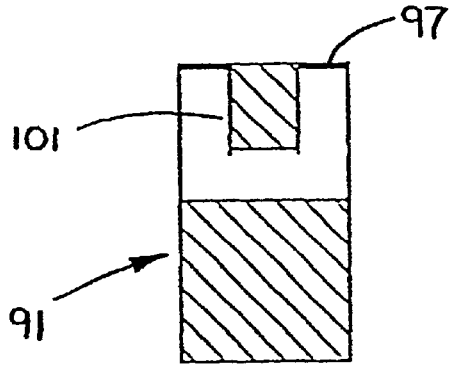
FIGS. 9*a* to 9*c* show respectively a cross-section, and end view and a perspective view from above of a spacer block.
Figure 9B:
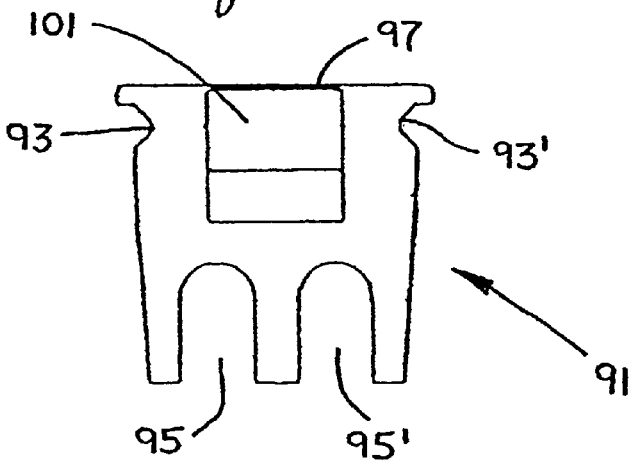
Figure 9C:
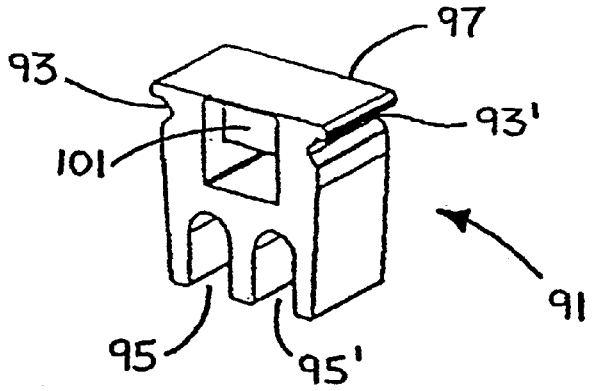

FIGS. 9*a* to 9*c* illustrate a moulded plastics spacer block 91 which again shares a common profile with other components of the system, namely the substantially V-shaped recesses 93, 93' on its outside walls into which the ribs 5, 5' of the mounting strip may be caught. The spacer block 91 has a further pair of recesses 95, 95' like those of the end cap 81, for both guiding and accommodating the electric cables constituting the power supply bus. The spacer block 91 is symmetrical and has an outer face 97 the central region of which is of thin section bounding an aperture 99 which extends all the way through. A reinforcing portion 101 depends from the outer face 97 midway through the aperture.

Figure 10:
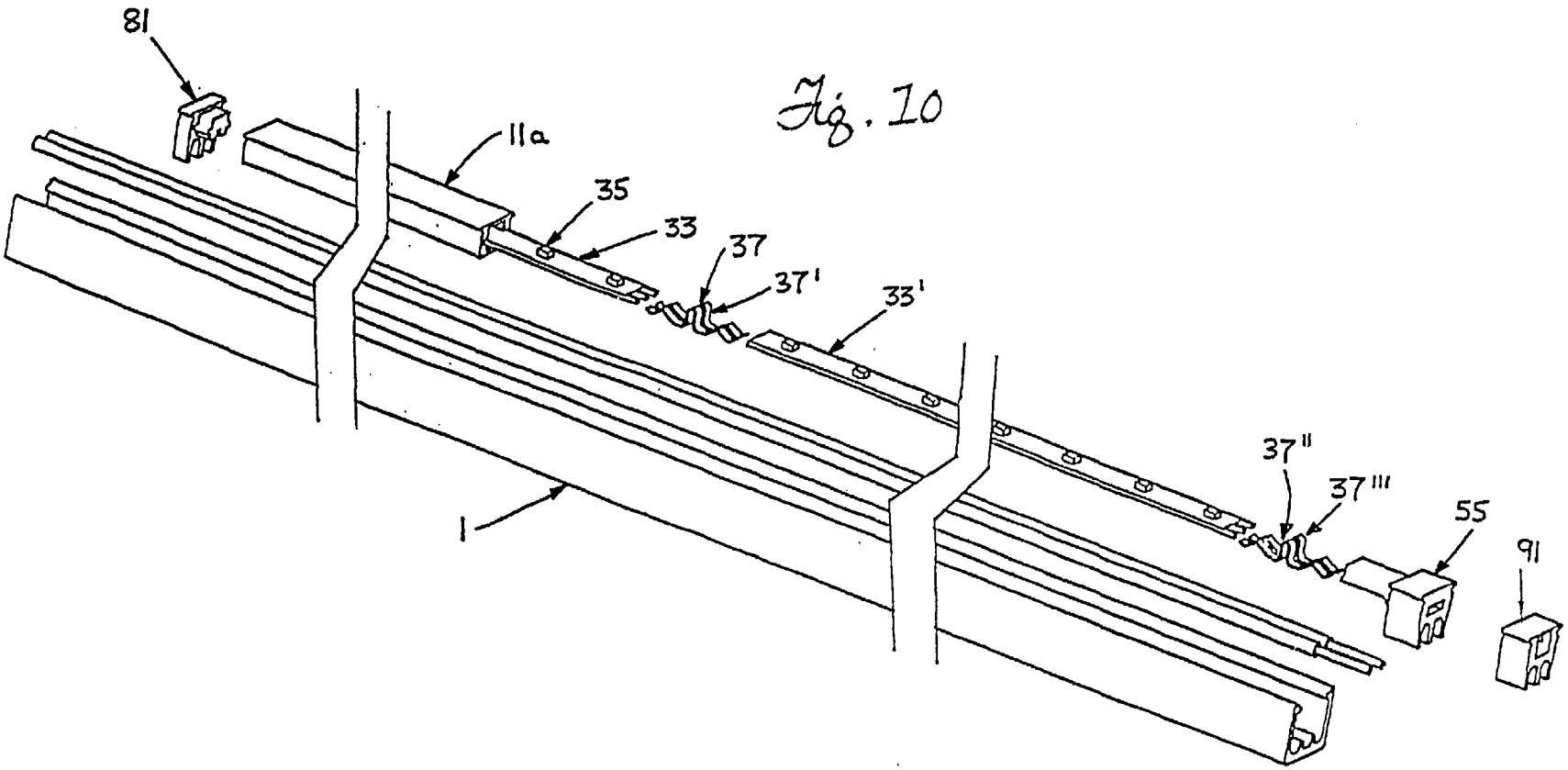
FIG. 10 shows an exploded view of an illumination system according to a preferred embodiment of the invention.

FIG. 10 is an exploded view providing an indication as to how all of the aforementioned components can be assembled to form an illumination system according to the invention. In particular, there is shown an elongate mounting strip 1; an emitter strip 11*a* into which a PCB 33 with surface mounted IR LEDs is partially inserted. Spring jumpers 37, 37' bridge the gap with an adjacent PCB 33'. The emitter strip 11*a* is of a length to accommodate several PCBs inside and its far end (as shown) is sealed by end cap 81. A pair of insulated cables 71, 71' extend through the mounting strip 1 adjacent the upstanding ribs running along the base of the channel. A connector block 55 forms an electrical connection to the PCB 33' via spring jumpers 37", 37'" and to the wires running through the insulated cables 71, 71' running underneath. The laterally extending arm of the connector block 55 is housed inside the hollow interior of the emitter strip 11*a* when the PCB 33' and spring jumpers 37", 37'" are slid in the hollow interior of emitter. The connector block 55 is adjacent a spacer block 91 and also guides the insulated cables 71, 71' underneath.

When assembled, the illustrated mounting strip may have fitted to it three emitter strips, each of which carrying three PCBs, and each having an end cap fitted at one end and a connector block and spacer block at the other end. Several mounting strips may be connected end-to-end to provide illumination across the entire area to be monitored. It will be further appreciated that the end cap 81, the emitter strip 11*a* housing PCBs 33, 33' and spring connectors 37, 37', 37", 37'" and the connector block 55 as shown in FIG. 10 may be supplied for use in the form of a single unit or sub-assembly. In such a case, the end cap 81 and connector block 55 will have been sealed to their respective ends of the emitter strip to provide a weatherproof housing for the IR LEDs and associated circuitry.

As will be readily understood, the invention can be used for virtually any static installation where covert illumination is required. Applications for the system of the invention range from security systems, for example, inside and/or outside government and public buildings, museums, and buildings of historical interest, to personnel monitoring systems, for example, in prisons and hospitals. The system may also be of particular value in the observation of nocturnal animals at zoos or in their natural habitat.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A modular illumination system comprising:

at least one mounting strip;

one or more emitter strips each having an outwardly directed face in use through which infrared light may be transmitted;

one or more printed circuit boards (PCBs) each carrying a plurality of infra red light emitting diodes (IR LEDs);

and one or more contact elements;

wherein the or each emitter strip is adapted to interconnect with a said mounting strip to form a conduit through which a power supply bus may be carried and wherein the or each contact element is adapted to complete an electrical connection between the power supply bus and a printed circuit board mounted behind the outwardly directed face of the emitter strip.

2. A system according to claim 1, wherein the or each emitter strip is adapted to receive one or more PCBs.

3. A system according to claim 2, wherein the or each emitter strip has an internal passage extending between opposite end faces in which the or each PCB may be accommodated.

4. A system according to claim 3, wherein the passage includes a pair of opposing recesses together forming a slot for supporting the or each PCB along its outer edges.

5. A system according to claim 2, wherein each emitter strip is adapted to receive a plurality of PCBs electrically connected in series.

6. A system according to claim 1, wherein the or each PCB carries one or more strings of IR LEDs, such that in use failure of an IR LED in one string does not break the electrical circuit to an adjacent string on the same PCB or on an adjacent PCB.

7. A system according to claim 1, further comprising one or more electrical bridge elements for making an electrical connection between adjacent PCBs and/or between a PCB and a contact element.

8. A system according to claim 7, wherein the or each electrical bridge element comprises a spring Jumper.

9. A system according to claim 1, wherein complementary interlocking means are provided on each of the mounting strip(s) and emitter strip(s) to allow the emitter strip(s) to be retained on the mounting strip(s).

10. A system according to claim 9, wherein the or each contact element is supplied on a connector block provided with complementary interlocking means to allow the connector block(s) to be retained on the mounting strip(s).

11. A system according to claim 9, wherein the emitter strip(s) are adapted to snap-fit with the mounting element(s).

12. A system according to claim 10, wherein the connector block(s) are adapted to snap-fit with the mounting element(s).

13. A system according to claim 12, wherein the mounting strip(s) comprises a substantially U-shaped channel member having resilient side walls and a pair of elongate projections oppositely disposed on the internal faces of the walls, and the emitter strip(s) and the connector block(s) are provided with corresponding recesses on their external wall or walls for snap-fitting with the projections.

14. A system according to claim 10, wherein the power supply bus comprises a pair of conductive tracks and the or each connector block carries a pair of contact elements so that each element forms an electrical connection with one of said pair of tracks.

15. A system according to claim 1, wherein the or each contact element includes first and second contact arms, one arm for connecting, directly or indirectly, to a conductive track on a PCB and the other arm for connecting to the power supply bus.

16. A system according to claim 15, wherein the first and second contact arms are disposed at about 90° to each other.

17. A system according to claim 16, wherein the or each contact element is supplied on a substantially L-shaped connector block.

18. A system according to claim 1, wherein the or each contact element includes a recessed metal blade for forging an electrical contact to the power supply bus when an insulated cable carrying the supply is pushed into the recess.

19. A system according to claim 18, wherein the or each mounting strip is provided with one or more complementary projections for urging the insulated cable into the recess during assembly of the system.

20. A system according to claim 1, wherein in use the or each contact element completes a parallel circuit between a PCB and the power supply bus.

21. A system according to claim 10, wherein the or each connector block cooperates with an emitter strip to form a sub-assembly ready for fixing on a mounting strip.

22. A system according to claim 1, further comprising one or more end caps adapted to interconnect with a mounting strip and to co-operate with an emitter strip for substantially preventing ingress of rain, dust or other undesirable substances into the assembled system.

23. A system according to claim 1, further comprising one or more spacer blocks adapted to interconnect with a mounting strip to facilitate positioning and holding of the power supply bus during connection of an emitter strip to the mounting strip.

24. A system according to claim 23, wherein the or each spacer block is provided with a tool access point to allow rapid ejection of the spacer block from the assembled system and thereby facilitate access to an adjacent emitter strip for replacement and/or maintenance purposes.

25. A surveillance system for monitoring activity around a protected site including an illumination system as claimed in claim 1 and one or more infra-red sensitive detectors adapted to convey an image of the illuminated site to a monitoring location.

26. A surveillance system according to claim 25, further including one or more passive infra-red sensors to provide a zonal intruder detector facility.

27. A surveillance system according to claim 26, wherein the or each sensor is linked to the illumination system to transmit a modulated signal to the power supply bus.

28. A surveillance system according to claim 27, wherein a plurality of emitter strips are provided and a proportion of such strips are adapted to carry a sensor.

29. A surveillance system according to claim 25, further including a photodetector unit for controlling power supplied to the or each emitter strip so that illumination is provided only during periods of darkness or low light conditions.

30. A method of covert surveillance of a chosen location comprising installing a system according to claim 25 at said location and transmitting images of the illuminated location to a remote monitoring site.

* * * * *